United States Patent [19]

Beer et al.

[11] 4,331,528

[45] May 25, 1982

[54] COATED METAL ELECTRODE WITH IMPROVED BARRIER LAYER

[75] Inventors: Henri B. Beer, Heide Kalmthout, Netherlands; Jean M. Hinden, Chambesy, Switzerland

[73] Assignee: Diamond Shamrock Corporation, Dallas, Tex.

[21] Appl. No.: 194,071

[22] Filed: Oct. 6, 1980

[51] Int. Cl.[3] ..... C25B 11/08; C25B 11/10

[52] U.S. Cl. ..... 204/290 F; 427/34; 427/226; 427/229; 427/423; 148/6.14 R

[58] Field of Search ..... 204/38 B, 290 F, 290 R, 204/98, 128; 427/34, 423, 229, 226; 148/6.14 R

[56] References Cited

U.S. PATENT DOCUMENTS

| | | | |
|---|---|---|---|
| 3,177,131 | 4/1965 | Angell et al. | 204/290 F |
| 3,366,464 | 1/1968 | Guichet et al. | 427/34 |
| 3,751,295 | 8/1973 | Blumenthal et al. | 427/34 |
| 3,853,739 | 12/1974 | Kolb et al. | 204/290 F |
| 3,869,312 | 3/1975 | Moss et al. | 204/290 F |
| 4,203,810 | 5/1980 | Warne et al. | 204/290 F |

*Primary Examiner*—R. L. Andrews

*Attorney, Agent, or Firm*—John P. Hazzard; Woodrow W. Ban

[57] ABSTRACT

An electrode for use in electrolytic processes comprises a substrate of film-forming metal such as titanium having a porous electrocatalytic coating comprising at least one platinum-group metal and/or oxide thereof possibly mixed with other metal oxides, in an amount of at least about 2 $g/m^2$ of the platinum-group metal(s) per projected surface area of the substrate. Below the coating is a preformed barrier layer constituted by a surface oxide film grown up from the substrate. This preformed barrier layer has rhodium and/or iridium as metal or compound incorporated in the surface oxide film during formation thereof in an amount of up to 1 $g/m^2$ (as metal) per projected surface area of the substrate.

40 Claims, No Drawings

COATED METAL ELECTRODE WITH IMPROVED BARRIER LAYER

TECHNICAL FIELD

The invention relates to electrodes for use in electrolytic processes, of the type having a substrate of a film-forming metal such as titanium, tantalum, zirconium, niobium, tungsten, aluminum and alloys containing one or more of these metals as well as silicon-iron alloys, coated with an electrocatalytic coating containing one or more platinum-group metals or their oxides possibly mixed with other oxides.

By "film-forming metal" is meant one which has the property that when connected as an anode in the electrolyte in which the coated anode is subsequently to operate, there rapidly forms a passivating oxide film which protects the underlying metal from corrosion by the electrolyte. These metals are also frequently referred to as "valve metals".

The invention is more particularly concerned with dimensionally-stable electrodes provided with an improved barrier or intermediate layer between the film-forming metal substrate and the electrocatalytic outer coating.

BACKGROUND ART

In early proposals (see for example U.K. Pat. Nos. 855,107 and 869,865, a titanium electrode with a coating of platinum group metal was provided with an inert barrier layer of titanium oxide in the porous places of the coating, this barrier layer preferably being formed or reinforced by a heat treatment. Later, in U.K. Pat. No. 925,080, the inert barrier layer of titanium oxide was preformed by electrolytically treating or heating the titanium substrate in an oxidizing atmosphere prior to application of the platinum group metal. The preforming of such a barrier layer was also advocated in U.K. Pat. No. 1,147,422 with a view to improving the anchorage of an active coating consisting of or containing platinum group metal oxides.

Later, the development of coatings formed of mixed crystals or solid solutions of co-deposited oxides of film-forming metals and platinum group metals (see U.S. Pat. No. 3,632,498) provided commercially viable electrodes which revolutionized the chlor-alkali industry and have become widely used in other applications. With these electrodes, excellent performance was achieved without the need for a reinforced or preformed inert barrier or anchorage layer on the substrate and today it is generally accepted that the preformed or reinforced inert barrier layers are detrimental to performance. In retrospect, the early proposals for preformed or reinforced inert barrier layers appear to have been unsuccessful attempts to avoid defects which were inherent in the previous coatings rather than in the substrate.

Nevertheless, some proposals attempting to improve inert barrier layers have still been made, for example by applying a titanium oxide barrier layer from a solution containing $Ti^{4+}$ ions. Again, this has been found to impair performance of the electrodes.

Another approach has been to provide a non-passivating barrier layer or intermediate layer underlying the active outer coating. Typical suggestions have been doped tin dioxide sub-layers; thin sub-layers of one or more platinum metals such as a platinum-iridium alloy; sub-layers of cobalt oxide or lead oxide, and so forth.

Although various patents have claimed marginal improvements for these electrodes in specific applications, in practice none of these suggestions has led to any significant improvement or any widespread commercial use.

DISCLOSURE OF THE INVENTION

The invention concerns an electrode with a film-forming metal substrate having a porous outer electrocatalytic coating containing at least about 2 $g/m^2$ (as platinum group metal per projected surface area of the substrate) of at least one platinum group metal and/or oxide thereof possibly mixed with other metal oxides, and an improved non-passivating barrier layer between the substrate and coating.

According to the invention, this barrier layer is a preformed surface oxide film grown up from the film-forming base and having rhodium and/or iridium incorporated in the surface oxide film during formation thereof in an amount of up to 1 $g/m^2$ (as metal) per projected surface area of the substrate.

The surface oxide film of the barrier layer is rendered non-passivating by the incorporation of the rhodium and/or iridium as metal or as a compound, usually the oxide or a partially oxidized compound.

Another aspect of the invention is a method of manufacturing such an electrode in which the formation of the barrier layer involves the application of a very dilute acidic paint, i.e. one which contains a small quantity of a thermodecomposable iridium and/or rhodium compound that during decomposition and simultaneous formation of the surface film of film-forming metal oxide will be fully absorbed by this surface film, this dilute paint containing generally about 1–15 g/l of iridium and/or rhodium (as metal).

The paint used will typically include an organic solvent such as isopropyl alcohol, an acid (notably HCl, HBr or HI) or another agent (e.g. NaF) which attacks the film-forming metal and encourages the formation of film-forming metal oxide during the subsequent heat treatment, and one or more thermo-decomposable salts of iridium and/or rhodium. Usually this solution will be at least five times more dilute and preferably about 10 or more times dilute (in terms of its precious metal content) than the paint solution which may be used for the production of the outer porous electrocatalytic oxide coatings; this means that the quantity of iridium, and/or rhodium, will be reduced, e.g. to 1/5 or 1/10 or even 1/100th the amount of the corresponding platinum-group metal in the paint used for producing the outer coating for approximately the same quantity of solvent and acid.

The action of the acid or other agent which attacks or corrodes the film-forming metal and promotes the formation of the oxide film during the subsequent heat treatment is very important; without a suitable agent producing this effect, formation of the surface oxide film of the film-forming metal would be substantially hindered or inhibited.

It has been observed that by applying one coat of a given solvent/acid mixture to a film-forming metal base subjected previously to the usual cleaning and etching treatments and then heating after drying to drive off the solvent, a given quantity of film-forming metal oxide will be produced. This procedure can be repeated a number of times (usually four or five times for 4 ml HCl in 60 ml isopropyl alcohol applied to a titanium base, dried and heated to 500° C. for ten minutes) before the growth of film-forming metal oxide during successive treatments becomes inhibited. The first layer of the integral surface oxide film formed will be relatively porous. This allows the subsequently-applied coat of the acid paint to penetrate this porous first layer during the drying phase so that the acid attacks the underlying film-forming metal. Ions of the film-forming metal are thus provided by the base for conversion to oxide during the subsequent heating, this oxide being partly formed within the pores of the first layer. The porosity of the resulting oxide film is thus reduced after each coating cycle until no more film-forming metal from the base can be converted to oxide. An extremely stable, relatively compact and impermeable film of film-forming metal oxide can thus be formed by the application of a limited number of coats of acid paint followed by drying and heating.

To prepare barrier layers according to the invention, each applied coat of paint includes such a small quantity of the iridium and/or rhodium compound that the electrocatalyst formed by thermodecomposition becomes fully incorporated in the integral surface film of film-forming metal oxide that is formed each time. Usually, each applied coat of the paint will contain at most about 0.2 g/m$^2$ of iridium and/or rhodium per projected surface area of the base, usually far less. Additionally, application of further layers of the dilute paint is stopped after the number of coats beyond which growth of the surface oxide film on the film-forming metal ceases or is inhibited. Thus, the optimum quantity of electrocatalytic agent in the dilute paint and the optimum number of coats to be applied to produce a satisfactory compact, impermeable barrier layer can be determined quite easily for any particular substrate, solvent/acid and electrocatalytic material. In many instances, two to ten layers of the very dilute paint will be applied, each followed by drying and heating from about 400° to 600° C. for about 5 to 15 minutes, with the possible exception of the final layer which may be heated for a longer period—possibly several hours or days at 450°-600° C. in air or in a reducing atmosphere (e.g. ammonia/hydrogen).

When viewed by the naked eye or under a microscope, barrier layers produced in this manner on an etched or non-etched titanium base usually retain the same range of distinctive appearances as titanium oxide films prepared in the same manner which do not contain the iridium and/or rhodium electrocatalyst, typically a bright blue, yellow and/or red "interference" film colour.

The dilute acidic paint solution used to prepare the barrier layer according to the invention preferably only includes a thermodecomposable iridium and/or rhodium compound, since the film-forming metal oxide component is provided by the base. However, the dilute paint may include small amounts of other components such as other platinum-group metals (ruthenium, palladium, platinum, osmium, in particular ruthenium), gold, silver, tin, chromium, cobalt, antimony, molybdenum, iron, nickel, manganese, tungsten, vanadium, titanium, tantalum, zirconium, niobium, bismuth, lanthanum, tellurium, phosphorous, boron, beryllium, sodium, lithium, calcium, strontium, lead and copper compounds and mixtures thereof. Usually, if any small quantity of a film-forming metal compound is used it will be a different metal to the film-forming metal substrate so as to contribute to doping of the surface film. Excellent results have been obtained with iridium/ruthenium compounds in a weight ratio of about 2:1, as metal. When such additives are included in the dilute paint composition, they will of course be in an amount compatible with the small amount of the main electrocatalyst, i.e. an iridium and/or rhodium compound, so that substantially all of the main electrocatalyst and additive is incorporated in the surface film of film-forming metal oxide. In any event, the total amount of iridium and/or rhodium and other metals is below 1 g/m$^2$, and usually below 0.5 g/m$^2$ and the extra metal will be present in a lesser amount than the rhodium and/or iridium. These iridium/rhodium compounds and other metal compounds may be thermodecomposable to form the metal or the oxide, but in neither case is it necessary to proceed to full decomposition. For example, barrier layers containing partially decomposed iridium chloride containing up to about 5% by weight of the original chlorine, have shown excellent properties. Barrier layers containing as little as 0.1 to 0.3 g/m$^2$ (as metal) of iridium and/or rhodium oxide/chloride in their surface films give excellent results. Tests have shown that a barrier layer containing 0.5 to 0.6 g/m$^2$ (as metal) of iridium produces an optimum effect in terms of the increased lifetime of the coated electrodes. Increasing the quantity of iridium above these values does not further increase the lifetime.

When a titanium substrate is used, the surface oxide film is found to be predominantly rutile titanium dioxide; presumably, the formation of rutile e.g. at about 400°14 500° C. is catalysed by the rhodium and/or iridium in the dilute coating solution.

After formation of the improved barrier layer which is impermeable to electrolyte and to evolved oxygen, the porous outer electrocatalytic coating is applied using standard techniques, for example by applying over the preformed barrier layer a plurality of coats of a relatively concentrated solution containing a thermodecomposable platinum-group metal compound and heating. Each applied outer coat will contain at least 0.4 g/m$^2$ of the platinum-group metal per projected area of the substrate, and the coating procedure is repeated to build up an effective outer coating containing at least about 2 g/m$^2$ of the platinum-group metal(s), usually in oxide form. The coating components may be chosen to provide a coating consisting predominantly of a solid-solution of at least one film-forming metal oxide and at least one platinum-group metal oxide, as described in U.S. Pat. No. 3,632,498. Advantageously, the coating is a solid solution of ruthenium and titanium oxides having a ruthenium:titanium atomic ratio of from 1:1 to 1:4. In this instance, the coating consists of several superimposed layers typically having a micro-cracked appearance and is quite porous. Employing an improved barrier layer according to the invention with such a coating greatly improves the performance of the electrode in standard accelerated life-time tests in oxygen-evolution conditions. Predictably, in the conditions for normal commercial production of chlorine, the improved electrode will have a substantially longer lifetime since it is known that one of the reasons for failure of these electrodes after extended use in chlorine production is due to the action of oxygen on the substrate. Also, it will be possible to obtain the same lifetime with an appreciable reduction in the outer coating thickness, enabling a saving in the quantity of coating material used and in the labour and energy consumed for production.

The outer coating may also be formed of one or more platinum-group metals, for example a platinum-iridium alloy, useful for chlorate production and to a limited extent in diaphragm or membrane calls for chlorine production. With conventional Pt/Ir coated electrodes, the coatings must be relatively thick (at least about 5 $g/m^2$) to avoid passivation problems. With the improved barrier layer according to the invention, thinner and more porous layers of the platinum metals can be used without problems arising due to oxidation of the substrate, or the drawbacks associated with the previously known passive barrier layers of titanium oxide.

It is also possible to apply the outer coating by plasma-spraying a solid solution of a film-forming metal oxide and a platinum-group metal oxide. For example, a solid solution powder can be prepared by flame-spraying as described in U.S. Pat. No. 3,677,975 and this powder is then plasma-sprayed onto the base. Alternatively, the coating is applied by plasma-spraying at least one film-forming metal oxide over the preformed barrier layer and subsequently incorporating the platinum-group metal(s) and/or oxides thereof in the plasma-sprayed film-forming metal oxide, for example according to the procedure of U.S. Pat. No. 4,140,813. Again, the improved barrier layer increases lifetime and enables a reduction of the precious metal content of the coating.

In a preferred method of mass-producing the electrodes, a set of electrode substrates are subjected together to a series of pre-treatments including etching and formation of the barrier layer by dip-coating the set of substrates in said dilute solution and heating the set of substrates, and thereafter the outer electrocatalytic coating is applied to the substrates one at a time. This procedure obviates the drawback in commercial electrode coating plants associated with a "bottleneck" between the etching bath and the coating line. In the usual mass-production procedure, a set of substrates is pretreated by sandblasting followed by etching, rinsing and drying and these substrates are then individually coated at a coating/baking line. It has thus been necessary to synchronize the etching with the coating/baking because the etched substrates cannot be left for long periods (more than about two days) without detriment to the electrode performance due to air oxidation of the substrate before coating, especially if dust or dirt becomes anchored in the thin oxide film. By pre-coating the sets of substrates with an improved barrier layer immediately after etching, this bottleneck effect is avoided and the surface-treated substrates can be stored without any risk of further oxidation. Any dust or dirt which may settle on the barrier layer can be easily blown off prior to coating, since it does not get anchored in the film.

Furthermore, the dip-coating procedure of a set of substrates piled against one another is satisfactory for the production of the improved barrier layer oxide film grown up from the substrate. Similar handling is not satisfactory for application of the conventional coatings where an added thickness of each applied coating must be built up over and on top of the film-forming metal base and its very thin surface oxide film.

The electrode base may be a sheet of any film-forming metal, titanium being preferred for cost reasons. Rods, tubes and expanded meshes of titanium or other film-forming metals may likewise be surface treated by the method of the invention. Titanium or other film-forming metal clad on a conducting core can also be used. For most applications, the base will be etched prior to the surface treatment to provide a rough surface giving good anchorage for the subsequently applied electrocatalytic coating. It is also possible to surface-treat porous sintered or plasma-sprayed titanium with the dilute paint solutions in the same manner, but preferably the porous titanium will be only a surface layer on a non-porous base.

The electrodes with an improved barrier layer according to the invention are excellently suited as anodes for chlor-alkali electrolysis. These electrodes have also shown outstanding performance when used for electrowinning in a mixed chloride-sulphate electrolyte giving mixed chlorine and oxygen evolution.

BEST MODES FOR CARRYING OUT THE INVENTION

This invention will be further illustrated in the following examples.

EXAMPLE I

Coupons measuring 7.5×2 cm of titanium available under the trade name "Contimet 30" were degreased, rinsed in water, dried and etched for ½ hour in oxalic acid. A paint solution consisting of 6 ml n-propanol, 0.4 ml HCl (concentrated) and 0.1 g of iridium and/or rhodium chloride was then applied by brush to both sides of the coupons in four thin coats. The coupons were dried to evaporate the solvent and then heated in air to 500° C. for 10 minutes after each of the first three coats and for 30 mins. after the final coat. This gives a content of about 0.2 to 0.3 $g/m^2$ of rhodium and/or iridium (calculated as metal) in the barrier layer depending on the amount of solution in each applied coat, as determined by weight measurement.

A titanium oxide-ruthenium oxide solid solution having a titanium: ruthenium atomic ratio of approximately 2:1 was then applied by brushing on a solution consisting of 6 ml n-propanol, 0.4 ml HCl (concentrated), 3 ml butyl titanate and 1 g $RuCl_3$ and heating in air at 400° C. for 5 mins. (Note: this solution is 10 times more concentrated in terms of precious metal:propanol solvent than is the dilute solution used for producing the barrier layer). This procedure was repeated until the coating was present in thickness of approximately 10 $g/m^2$ (i.e. approx. 4 $g/m^2$ of Ru metal).

Electrodes so produced are being subjected to comparative electrochemical tests with similar electrodes (a) having a $TiO_2$ barrier layer produced by the same procedure but with a paint consisting solely of 6 ml n-propanol and 0.4 ml HCl (concentrated) and (b) having no barrier layer. The initial results indicate that the electrode according to the invention has a greatly superior lifetime in accelerated lifetime tests as anodes in oxygen evolving conditions and, in chlor-alkali electrolysis, should have a lifetime many times longer than comparative anode (a) and considerably longer than comparative anode (b).

EXAMPLE II

A titanium coupon was degreased, rinsed in water, dried, etched and then surface-treated as in Example I with a paint solution containing iridium and ruthenium chlorides in the weight ratio of 2:1 (as metal). The treatment was repeated four times until the titanium dioxide film formed contained an amount of 0.2 $g/m^2$ Ir and 0.1 $g/m^2$ Ru, both calculated as metal. The heat treatment was carried out at 400° C. for 10 minutes after each applied coat. An outer coating of $TiO_2.RuO_2$ was then applied as in Example I. The same comparative electrochemical tests have given the same initial promising results as for Example 1.

EXAMPLE III

Titanium coupons were degreased, rinsed in water, dried and etched as in Example I and treated with an iridium chloride solution similar to that of Example I. The solution was applied in four thin coats and the coupons were dried to evaporate the solvent and then heated to 480° C. for 7 minutes at the end of each coat. The iridium concentration was varied to give a content of 0.3, 0.6 and 0.8 g/m$^2$ of iridium (calculated as metal) in the barrier layer.

A titanium dioxide-ruthenium dioxide solid solution coating was then applied as in Example I, except that the coating thickness corresponded to 20 g/m$^2$ (approx. 8 g/m$^2$ of Ru metal). These electrodes were subjected to accelerated lifetime tests in oxygen evolving conditions. The maximum lifetime was observed with the coupon having a barrier layer containing 0.6 g/m$^2$ Ir. This represented an increase by a factor of 10.3 of the lifetime of a similar electrode without a barrier layer (or with a barrier layer of $TiO_2$ containing no iridium). In comparison, a similar coated electrode with no barrier layer but with the addition of 0.6 g of iridium dispersed in the coating shows only a marginal increase of lifetime.

EXAMPLE IV

Electrodes were prepared in a similar manner to Example I, but using a dilute paint containing chlorides of various platinum-group metals, including palladium, platinum and ruthenium alone, as well as rhodium and iridium as previously described, for production of the barrier layer. These electrodes were subjected to comparative lifetime tests as oxygen-evolution anodes. Only the electrodes having a barrier layer containing Rh and/or Ir showed a marked increase in lifetime in this test; combinations of Rh and/or Ir with smaller quantities of the other platinum-group metals or their compounds, in particular Ru and Pd also produced substantial improvements.

EXAMPLE V

Titanium coupons were provided with barrier layers containing approx. 0.2 g/m$^2$ of iridium and/or rhodium following the procedure of Example I. They were then painted with a solution containing 0.5 g of iridium chloride and 1 g of platinum chloride in 10 ml of isopropyl alcohol and 10 ml of linalool, and heated in an oven to 350° C. An ammonia/hydrogen mixture was then passed for approximately 30 seconds to produce a coating containing 70% Pt and 30% Ir. The coating procedure was repeated to build up a coating containing 4 g/m$^2$ of the Pt/Ir alloy. For similar electrodes coated with less than 7 g/m$^2$ of the Pt/Ir alloy but without the improved barrier layer, it has been reported that operation at elevated current density produces passivation and at least 7 g/m$^2$ must be applied to obtain satisfactory operation over extended periods. This problem is apparently overcome by the electrode according to the invention which operates satisfactorily with a coating of 4 g/m$^2$.

EXAMPLE VI

Titanium coupons were provided with barrier layers containing approx. 0.2 g/m$^2$ of iridium and/or rhodium following the procedure of Example I. A layer of approximately 400 g/m$^2$ of titanium oxide was then plasma-sprayed onto the barrier layer, using standard techniques. The plasma-sprayed titanium oxide layer was then coated with coatings containing 2 g/m$^2$ (as metal) of ruthenium oxide and/or iridium oxide in various ratios, by painting with a solution of 6 ml propanol and 1 g of $RuCl_3$ and/or $IrCl_3$ and heating in air to 500° C. for 10 minutes after each coating. Preliminary electrochemical testing indicates that these electrodes should have an extremely long lifetime as anodes in mercury chlor-alkali cells operating at high current densities. From the data published in U.S. Pat. No. 4,140,813, it seems that the electrode of this invention will achieve the same excellent lifetime with as little as 1/5th of the precious metal loading.

EXAMPLE VII

Titanium coupons were provided with barrier layers containing approx. 0.3 g/m$^2$ of iridium, rhodium and iridium/ruthenium in a 2:1 weight ratio, following the procedure of Example I (except that in some instances the final heating was prolonged for several hours).

An aqueous solution containing iridium chloride and tantalum chloride (with Ir and Ta metals in an equal weight ratio) was applied by brush over both sides of the coupons in 5, 10 and 15 coats. Each applied coat contained about 0.5 g/m$^2$ of iridium. After each coat, the coupons were dried and heated in air for 10 minutes at 450° C., and for 1 hour after the final coat. The resulting coating was a solid solution of iridium and tantalum oxides containing approx. 2.5, 5 and 7.5 g/m$^2$ of iridium. The electrodes were tested as anodes in 10% sulfuric acid at 60° C. at a current density of 1.2 kA/m$^2$, the current being stopped for 15 minutes in each 24-hour period without the electrodes being removed from the acid bath. The initial results indicate a superior performance over similar electrodes on a plain titanium substrate and on a substrate of a titanium-palladium alloy containing 0.15% palladium. The titanium substrate with a barrier layer according to the invention is of course far less expensive than this titanium-palladium alloy and provides a greatly improved resistance to cell shutdown and to the passivating action of oxygen evolution. From the preliminary indications, the electrodes according to the invention with a low iridium loading (2.5 g/m$^2$+0.3 g/m$^2$ in the barrier layer) should have an outstanding lifetime compared to similar electrodes without the barrier layer.

We claim:

1. An electrode for use in electrolytic processes comprising: a film forming metal substrate having a porous electrocatalytic coating comprising at least one of a platinum-group metal and a platinum-group metal oxide in an amount of at least about 2 g/m$^2$ over the projected surface area of the substrate, and the substrate having below the coating a preformed barrier layer of a surface oxide film grown up from the substrate and at least one of rhodium and iridium oxides incorporated in the surface oxide film during formation thereof in an amount of up to 1 g/m$^2$ on a metal weight basis per projected surface area of the substrate.

2. The electrode of claim 1, wherein the porous electrocatalytic coating consists of a plurality of superimposed layers of micro-cracked configuration.

3. The electrode of claim 2, wherein the porous electrocatalytic coating consists predominantly of a solid-solution of at least one film-forming metal oxide and at least one platinum-group metal oxide.

4. The electrode of claim 3, wherein the porous electrocatalytic coating is a solid solution of ruthenium and titanium oxides having a ruthenium:titanium atomic ratio of from 1:1 to 1:4.

5. The electrode of claim 1, wherein the porous electrocatalytic coating consists predominantly of at least one platinum-group metal.

6. The electrode of claim 5, wherein the porous electrocatalytic coating is a platinum-iridium alloy.

7. The electrode of claim 1, wherein the porous electrocatalytic coating is a plasma-sprayed layer of at least one film-forming metal oxide incorporating at least one of a platinum-group metal and a platinum group metal oxide.

8. The electrode of claim 1, wherein the surface oxide film of the barrier layer contains at least one extra added metal in addition to one of rhodium and iridium but in a lesser amount than the rhodium iridium, the total metal content of the barrier layer being up to 1 $g/m^2$.

9. The electrode of claim 8, wherein said film contains up to 0.5 $g/m^2$ or iridium and ruthenium in a weight ratio of about 2:1.

10. The electrode of claim 1, wherein the substrate is titanium and the surface oxide film is predominantly rutile titanium dioxide grown up from the substrate.

11. A method of manufacturing an electrode for use in electrolytic processes, comprising forming a barrier layer on a film-forming metal substrate and applying over the barrier layer a porous outer electrocatalytic coating comprising at least one of a platinum-group metal and a platinum group metal oxide, in an amount of at least about 2 $g/m^2$ over the projected surface area of the substrate, the barrier layer being formed by applying to the substrate at least one coating of a very dilute acid solution containing thermodecomposable compounds of at least one of rhodium and iridium, separately drying and heating each applied barrier coating to form on the substrate a mixed crystal metal oxide barrier layer of substrate metal oxide and oxide decomposition products of the thermodecomposable compounds contained in the very dilute solution, the number of applied coats being such that the barrier layer so formed contains up to 1.0 $g/m^2$ of oxides of the thermodecomposable compounds on a metal weight basis over the projected surface area of the substrate.

12. The method of claim 11, wherein each applied coat of the solution contains up to 0.2 $g/m^2$ of rhodium and iridium metal over the projected surface area of the substrate.

13. A method of manufacturing an electrode for use in electrolytic processes, comprising forming a barrier layer on a film-forming metal substrate and applying over the barrier layer a porous outer electrocatalytic coating comprising at least one of a platinum group metal and platinum metal oxide, in an amount of at least about 2 $g/m^2$ on a metal weight basis over the projected surface area of the substrate, the barrier layer being formed by applying to the substrate several coatings each containing up to 0.2 $g/m^2$ on a metal weight basis over the projected surface area of the substrate of thermodecomposable compounds of at least one of rhodium and iridium in a film-forming metal attacking solution, and drying and heating each coating after application to produce a mixed crystal barrier layer of oxides of the film-forming metal grown up from the substrate up to a total of 1.0 $g/m^2$ of iridium and rhodium oxides on a metal weight basis.

14. The method of claim 13, wherein from 2 to 5 coatings of the dilute solution are applied each followed by heating to between about 300° and 600° for between about 5 and 15 minutes, the final coat being heated at least as long as previous coatings.

15. The method of claim 13, wherein the heating is carried out to imcompletely decompose the decomposable compound.

16. The method of claim 13, wherein the porous outer electrocatalytic coating is formed by applying over the preformed barrier layer a plurality of coats of a relatively concentrated solution containing a thermodecomposable platinum group metal compound and heating.

17. The method of claim 16, wherein each applied outer coat contains at least 0.4 $g/m^2$ of platinum group metal per projected area of the substrate base.

18. The method of claim 13, wherein the porous outer electrocatalytic coating is applied by plasma-spraying.

19. The method of claim 13, wherein the porous outer electrocatalytic coating is applied by plasma spraying at least one film-forming metal oxide over the preformed barrier layer and subsequently incorporating one of the platinum group metal and platinum group metal oxides in the plasma-sprayed film-forming metal oxide.

20. The method of claim 13, wherein a set of electrode substrates are subjected together to a series of pretreatments including etching and formation of the barrier layer by dip-coating the set of substrates in the solution, and heating the set of substrates; thereafter the outer electrocatalytic coating being applied to the substrate one at a time.

21. The electrode produced by the method of any of claims 11 to 20.

22. An electrode for use in electrolytic processes comprising a substrate of film-forming metal having a porous electrocatalytic coating comprising at least one of a platinum-group metal and a platinum-group metal oxide in an amount of at least about 2 $g/m^2$ over the projected surface area of the substrate, and the substrate having below the coating a preformed barrier layer consisting essentially of a surface oxide film grown up from the substrate, and at least one of rhodium and iridium oxides, together with a further metal incorporated in the surface oxide film during formation thereof in an amount of not more than about 1 $g/m^2$ on a metal weight basis per projected surface area of the substrate.

23. The electrode of claim 22 wherein the surface oxide film comprises not more than 1 $g/m^2$ iridium and ruthenium in a weight ratio of about 2 to 1.

24. An electrode for use in electrolytic processes comprising a titanium substrate having a porous electrocatalytic coating comprising at least one of a platinum-group metal and a platinum-group metal oxide in an amount of at least about 2 $g/m^2$ over the projected surface area of the substrate, and the substrate having below the coating a preformed barrier layer consisting essentially of a rutile titanium dioxide film grown up from the substrate, and at least one of rhodium and iridium together with a further metal incorporated in the surface oxide film during formation thereof in an amount of not more than about 1 $g/m^2$ on a metal weight basis per projected surface area of the substrate.

25. The electrode of claim 24 wherein the surface oxide film comprises not more than 0.5 $g/m^2$ of iridium and ruthenium in a weight ratio of about 2 to 1.

26. The electrode of any of claims 1, 22, 23, 24, and 25, wherein the porous electrocatalytic coating comprises a plurality of superimposed layers of microcracked configuration.

27. The electrode of claim 26, wherein the porous electrocatalytic coating consists predominantly of a solid-solution of at least one film-forming metal oxide and at least one platinum-group metal oxide.

28. The electrode of claim 27, wherein the porous electrocatalytic coating is a solid-solution of ruthenium and titanium oxides having a ruthenium-titanium atomic ratio of from 1:1 to 1:4.

29. The electrode of any of claims 1, 22, 23, 24, and 25, wherein the porous electrocatalytic coating is comprised of more than one platinum-group metal.

30. The electrode of any of claims 1, 22, 23, 24, and 25, wherein the porous electrocatalytic coating is comprised of a platinum-iridium alloy.

31. The electrode of any of claims 1, 22, 23, 24, and 25, wherein the porous electrocatalytic coating is comprised of a plasma-sprayed layer of at least one film-forming metal oxide incorporating at least one of the platinum-group metals and the platinum-group metal oxides thereof.

32. The electrode of any of claims 1, 22, 23, 24, and 25, wherein the surface oxide film of the barrier layer includes at least one metal in addition to at least one of rhodium and iridium but in a lesser amount than the rhodium and iridium with the total metal content of the barrier layer being not more than about 1 $g/m^2$.

33. A method for manufacture of an electrode for use in an electrolytic process comprising the steps of:

(1) selecting an electrode having a film-forming metal substrate surface;

(2) selecting a relatively dilute coating solution comprising at least one thermodecomposable compound of at least one of rhodium and iridium metals, the coating solution being of a type at least mildly chemically aggressive to the film forming metal and forming a barrier layer grown up from the substrate;

(3) applying the coating solution to the electrode;

(4) drying the applied coating solution and heating the electrode and the applied coating solution to at least partially thermally decompose the solution metals and to at least partially oxidize the film-forming metal at the surface of the substrate, thereby incorporating a substantial portion of the solution metals into the substrate surface constituting an electrode barrier coating;

(5) repeating steps (3) and (4) until a desired quantity of the barrier solution metals have been incorporated into the substrate surface;

(6) selecting an electrocatalytic coating compound comprising at least one of a platinum-group metal and a platinum-group metal oxide of the type forming a electrocatalytic coating;

(7) making at least one application of the electrocatalytic coating compound to the electrode, thereby establishing an outer electrocatalytic coating on the electrode; and (8) controlling the application of the electrocatalytic coating compound whereby platinum-group metal and platinum-group metal oxide accumulating over the projected surface area of the substrate is greater than about 2 $g/m^2$.

34. The method of claim 33 wherein the dilute solution is mildly acidic.

35. The method of claim 33 wherein the electrocatalytic coating compound comprises a solution of a thermodecomposable platinum-group metal compound and including the additional steps of:

(1) applying at least one coating of the electrocatalytic coating solution to the electrode and heating the electrode to thermally decompose the thermodecomposable platinum-group metal compound; and (2) limiting each said coating layer to not more than 0.2 $g/m^2$ of platinum-group metal per projected area of the substrate base.

36. The method of claim 33 including the step of applying the electrocatalytic coating compound by plasma spraying.

37. The method of claim 33 including the additional step of applying by plasma spraying at least one coating of an oxide of a film-forming metal over the barrier coating prior to application of the electrocatalytic coating compound, and including the step of applying the electrocatalytic coating compound by plasma spraying.

38. The method of claim 33 including the step of heating the electrode following an application of the barrier coating solution to a temperature between about 300° and about 600° C. for a period of from about 5 minutes to about 15 minutes.

39. The method of claim 35 including the step of heating the electrode following an application of barrier coating solution to a temperature between about 300° C. and about 600° C. for a period of from about 5 minutes to about 15 minutes.

40. An electrode produced by the method of any of claims 33, 34, 35, 36, 37, 38, and 39.

* * * * *

UNITED STATES PATENT AND TRADEMARK OFFICE

CERTIFICATE OF CORRECTION

PATENT NO. : 4,331,528

DATED : May 25, 1982

INVENTOR(S) : Henri B. Beer and Jean M. Hinden

It is certified that error appears in the above-identified patent and that said Letters Patent are hereby corrected as shown below:

In column 4, line 31, the characters "14" should read as a hyphen.

In column 5, line 4, the word "calls" should read -- cells --.

In column 9, line 20, insert "/" between the words "rhodium" and " iridium".

Signed and Sealed this

*Twenty-third* Day of *November 1982*

[SEAL]

*Attest:*

GERALD J. MOSSINGHOFF

*Attesting Officer*

*Commissioner of Patents and Trademarks*